US005743763A

United States Patent [19]

Giovanni

[11] Patent Number: 5,743,763

[45] Date of Patent: Apr. 28, 1998

[54] INDUSTRIAL-TYPE MOBILE ELECTRIC SOCKET AND PLUG OF EASIER ASSEMBLING

[75] Inventor: Mapelli Giovanni, Ranica, Italy

[73] Assignee: Scame Parre S.p.A., Parre, Italy

[21] Appl. No.: 569,142

[22] PCT Filed: Jun. 30, 1994

[86] PCT No.: PCT/IT94/00101

§ 371 Date: Mar. 22, 1996

§ 102(e) Date: Mar. 22, 1996

[87] PCT Pub. No.: WO95/01664

PCT Pub. Date: Jan. 12, 1995

[30] Foreign Application Priority Data

Jul. 1, 1993 [IT] Italy ..... MI930540 U

[51] Int. Cl.[6] ..... H01R 13/40

[52] U.S. Cl. ..... 439/598; 439/903

[58] Field of Search ..... 439/321, 318, 439/598, 903

[56] References Cited

U.S. PATENT DOCUMENTS 4,053,198 10/1977 Doyle et al. .
4,354,723 10/1982 Lee .
4,793,821 12/1988 Fowler et al. ..... 439/321
4,834,667 5/1989 Fowler et al. ..... 439/321
5,145,394 9/1992 Hager ..... 439/321

FOREIGN PATENT DOCUMENTS 596677 3/1978 Switzerland .

*Primary Examiner*—Gary F. Paumen
*Attorney, Agent, or Firm*—Seidel, Gonda, Lavorgna & Monaco, PC

[57] ABSTRACT

An electrical connector, such as a socket or plug, comprises an insert which is mounted on the housing by relative rotational movement therebetween. The insert is restrained on the housing by an interlocking resilient detent member located in a seat formed on one of the parts and a notched projection formed on the other part. The detent member and notched projection prevents rotation of the housing and insert when interengaged. The resilient detent member and the projection form a connection which is adapted to be engaged by an external tool for disengaging the resilient detent member from the projection when the resilient detent member is engaged with the projection.

10 Claims, 2 Drawing Sheets

INDUSTRIAL-TYPE MOBILE ELECTRIC SOCKET AND PLUG OF EASIER ASSEMBLING

FIELD OF THE INVENTION

The present invention concerns mobile electrical connectors, such as sockets and plugs of industrial type, and in particular a socket and a plug which facilitates assembly.

As it is known, many electric apparatuses are used both in the industrial field in general and in the handicraft and services fields. These require a connection to the electrical network or one to the other through mobile, i.e. not wall-fixed, plugs and sockets.

The safety regulations for these product are increasingly strict and in particular the latest IEC regulation concerning this matter (309-1-2) requires that the mobile plugs and sockets are made in such a way as to necessarily require a tool to disassemble them.

The plugs and sockets comprise said application, in a first part, called "housing", and a second part, called an "insert", which is mounted on the housing. Reference will be made in the following to a socket, being clear that what will be said can be applied to a plug too.

In the sockets of the prior art, the mounting of the insert on the housing is usually carried out by means of a pair of screws, so as to satisfy the above-cited IEC 309-1-2 regulation. This is because it is not possible to disassemble the socket with the bare hands; a screwdriver is required.

An example of such a socket is disclosed in CH-A-596.677 which relates to a two-part connecter plug assembled by means of a bayonet arrangement which is secured by means of screws or the like.

However, this solution has the serious drawback that the mounting also obviously requires the use of the screwdriver and therefore wastes time. Since these mobile sockets and plugs are mounted in thousands on various electric tools and the like (drills, welders, etc.) which are used in the environments considered in the relevant plant regulations, a substantial waste of time results from their use with a consequent increase in the labour cost for the assembly of the plugs and sockets.

A socket already exists which overcomes these drawbacks by means of two shaped profiles which are formed on the facing surfaces of two projections located in the frontal area of the coupling abutments. These projections may be mutually engaged so as to block the rotation between the insert and the housing leaving therebetween a cavity wherein a tool is to be inserted to disengage said profiles.

This solution, though effective, has the drawback that the tool directly acts on the shaped profiles, usually made of plastic, and can thus cause a permanent deformation, especially in case of repeated disassembling.

SUMMARY OF THE INVENTION

Therefore, the object of the present invention is to provide an electrical connector which can be easily assembled with no need to use tools or additional fastening elements such as screws, yet can satisfy the above-cited IEC 309-1-2 regulation and does not cause deterioration of the blocking members even in case of repeated disassembling.

This object is achieved by means of an electrical connector, such as a socket, having the characteristics cited in claim 1.

The electrical connector of the present invention significantly reduces the time, and, thus, the cost, required for mounting the insert in the housing.

A further advantage, with respect to the electrical connector of the present invention is that it is capable of repeated disassembly without deterioration of the blocking elements.

BRIEF DESCRIPTION OF THE DRAWINGS

These and other advantages and characteristics of the device according to the present invention will be apparent from the following detailed description of a preferred embodiment thereof, reported as a nonlimiting example, referring to the annexed drawings wherein.

DETAILED DESCRIPTION OF THE INVENTION

Figure 1:
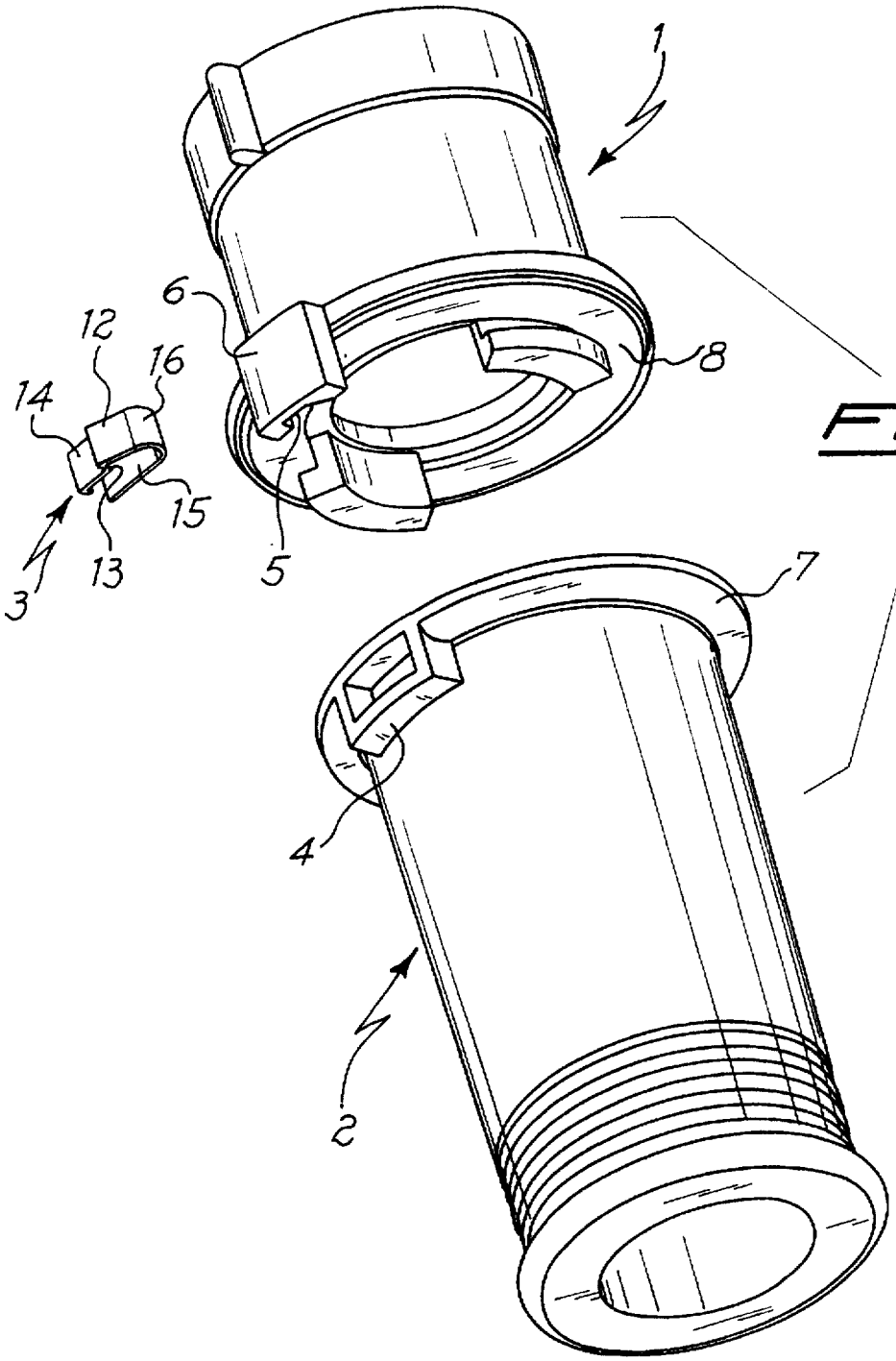
FIG. 1 is a perspective exploded view of the members making up the socket according to the present invention.

Referring to FIG. 1, there is shown an electrical connector, such as a socket or plug, according to the present invention. The electrical connector comprises an insert 1 mounted on a housing 2 by means of a pair of planes inclined with respect to the socket axis. The planes cover a limited arc of the socket periphery. The mounting is carried out by rotating insert 1 with respect to housing 2 until the inclined planes force the two parts to abut against each other.

The electrical connector according to the present invention can satisfy the above-cited regulation due to the inclusion of a device for blocking insert 1 on housing 2 comprising a resilient member 3. The resilient detent member 3 is inserted in a seat 4 and shaped so as to be engaged by a correspondingly shaped inner surface 5 of a projection 6. In the illustrated embodiment, seat 4 is formed below abutment 7 of housing 2, while projection 6 is positioned below abutment 8 of insert 1. Clearly, this arrangement could be inverted by forming seat 4 above abutment 8 and by positioning projection 6 above abutment 7.

Figure 2:
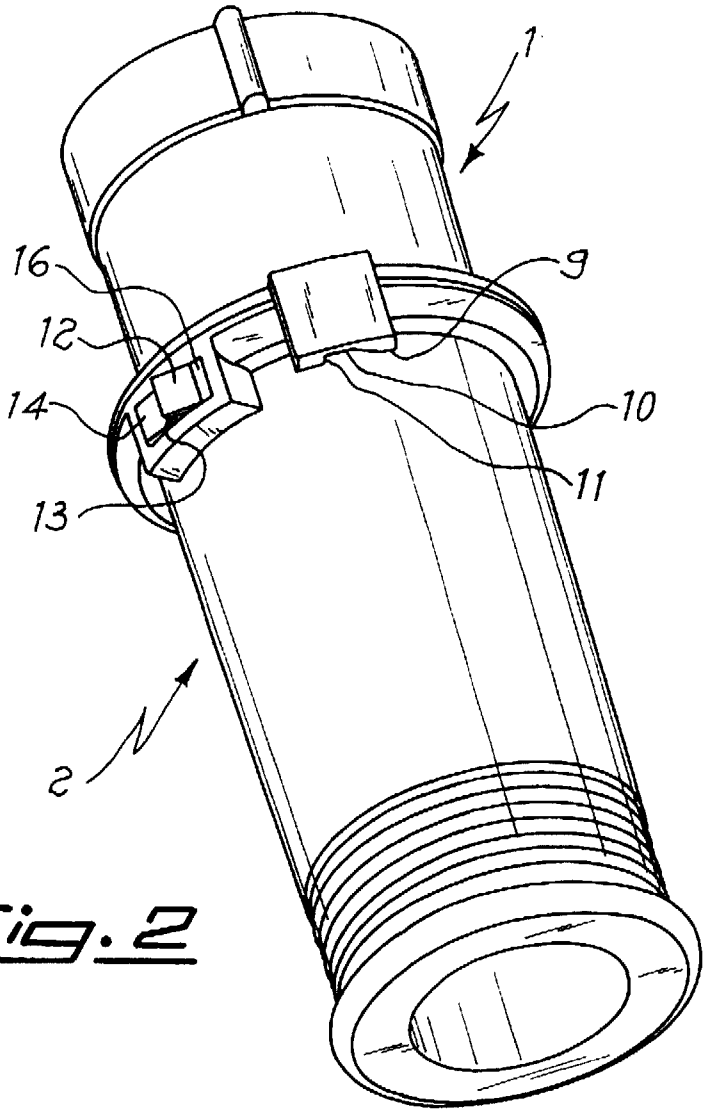
FIG. 2 is a perspective view of the three parts of the preceding figure assembled but not yet blocked.

The projection 6 has a detent profile formed in its inwardly facing surface 5. As best seen in FIG. 2, the profile of the surface 5 includes an inclined segment 9 which begins near the closest edge of the projection 6, in the direction of rotational assembly of the insert and housing, and extends toward the center of the projection. An intermediate segment 10 extends from the end of the inclined segment 9 which is most distant away from the direction of the rotation of assembly. The intermediate segment 10 is substantially coplanar with a plane tangent to the surface of the connector housing. A transverse segment 11 extends substantially orthogonally from the end of the intermediate segment 10 and is parallel to the longitudinal axis of the electrical connector. Together the segments 9, 10, and 11 form a notched profile in the inwardly facing surface 5 of projection 6.

Similarly, the outer profile of the resilient detent member 3 includes an inclined segment 12 which is substantially complementary with the inclined segment 9. A transverse segment 13 extends from the end of the inclined segment 12 similarly to and complementary with the transverse segment 11. A lateral segment 14 extends substantially orthogonally from the transverse segment 13. The intermediate segment 10 is substantially coplanar with a plane tangent to the surface of the connector housing. Segments 12, 13 and 14 form a protruding tooth-like upper surface which is complementary with the notch 5. A curved radius 16 connects the upper surface of the resilient detent member 3 with a lower segment 15 which abuts the bottom of the seat 4.

The resilient detent member is made from a resiliently bendable material, such as spring steel. The curved resilient radius 16 permits the upper tooth-like surface of the detent member 3 to deflect toward the lower segment 15 upon the application of a force thereon.

Figure 3:
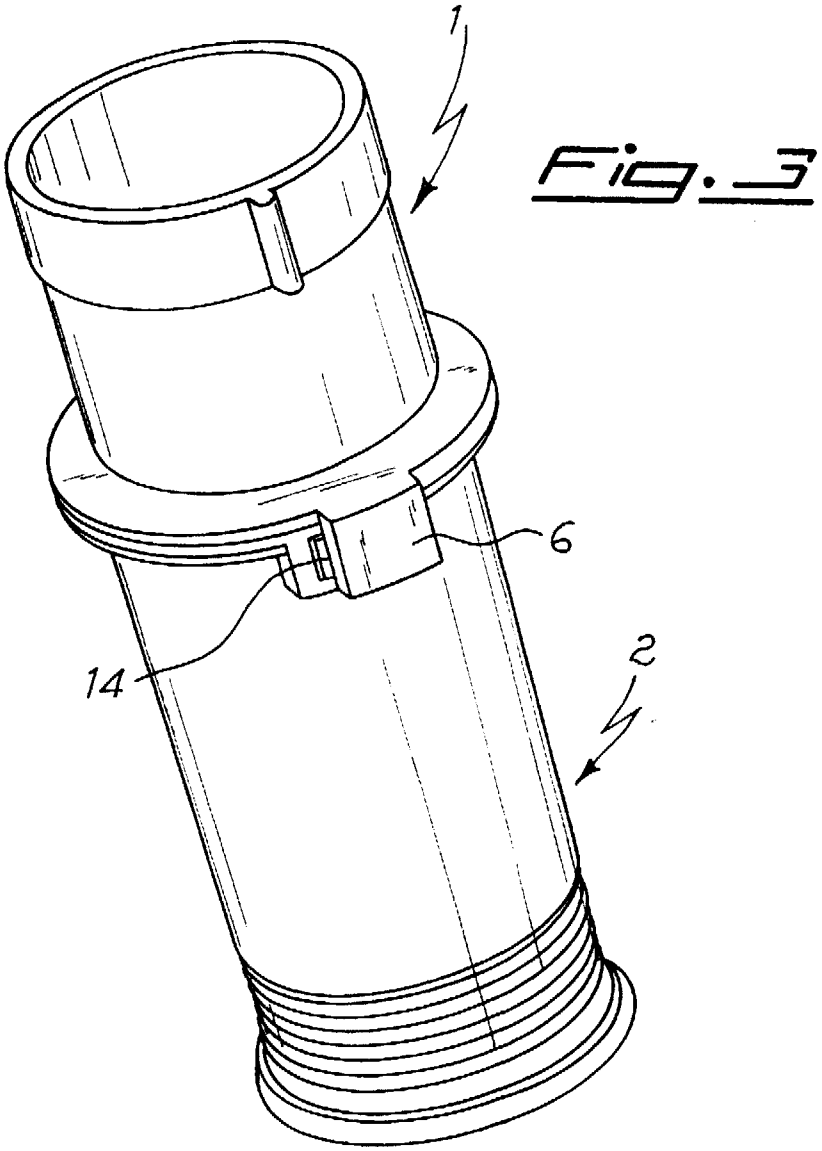
FIG. 3 is a perspective view of the socket of FIG. 2 in the blocked position.

Referring finally to FIG. 3, there is seen that, by performing a counter-clockwise rotation of insert 1 from the position of FIG. 2, projection 6 engages member 3 so as to block the rotation of the two parts of the electrical connector. In particular, the tooth formed by segment 13 is engaged by the abutment formed by segment 11. When the detent member 3 is fully engaged with projection 6, the laterally extending segment 14 is partially uncovered, i.e. the segment 14 extends beyond the leading edge of the projection 6. In this position, segment 14 is below the edge of the seat 4. The tooth can be disengaged from the abutment by pushing on the uncovered portion of segment 14 with a screwdriver, or a similar tool, thus allowing the socket to be disassembled.

It is clear that the above-described and illustrated embodiment is merely one example of the shapes of member 3 and projection 6 which make up the blocking or latent device. The same kind of device may be realized with numerous variations of the profile used in the present invention, and the kind of axial restraint between insert 1 and housing 2 may be different as well. For example a screw thread may be used instead of inclined segments, as long as the axial restraint requires rotation between the parts for the disassembly.

What is claimed is:

1. An electrical connector comprising:

a connector housing; a connector insert removably mounted on the housing by relative rotational movement therebetween; a projection formed on one of the housing and the insert; a seat formed on the other of the housing and insert; a resilient detent member located in the seat; the projection having an inwardly facing surface shaped to engage a complementary surface of the resilient detent member so as to prevent relative rotation between the connector housing and the insert when the detent and projection are interengaged; and an actuator portion which is externally accessible for disengaging the resilient detent member from the projection.

2. The electrical connector according to claim 1, wherein the seat and the projection are located on the same side of the electrical connector with respect to the longitudinal position at which the insert and housing are in contact.

3. The electrical connector according to claim 1, wherein the resilient member comprises a tooth defined by (i) an inclined segment which is inclined in the direction of rotation for assembling the electrical connector, (ii) a radially inwardly extending segment located at an end of the inclined segment, the radial segment defines the complementary surface, and (iii) an orthogonal segment which extends substantially orthogonally from the radial segment.

4. The electrical connector according to claim 3, wherein the orthogonal segment defines the actuator portion.

5. The electrical connector according to claim 1, wherein the resilient detent member is made of spring steel.

6. An electrical connector comprising:

a connector housing; a connector insert removably mounted on the housing by relative rotational movement therebetween; a projection formed on one of the housing and the insert; a seat formed on the other of the housing and insert; a resilient detent member located in the seat; the projection having an inwardly facing surface shaped to engage a complementary surface of the resilient detent member so as to prevent relative rotation between the connector housing and the insert when the insert and projection are interengaged; and a portion which is exposed to the outer periphery of the connector and engagable by a tool for disengaging the resilient detent member from the projection.

7. The electrical connector according to claim 6, wherein the seat and the projection are located on the same side of the electrical connector with respect to the longitudinal position at which the insert and housing are in contact.

8. The electrical connector according to claim 6, wherein the resilient member comprises a tooth defined by (i) an inclined segment which is inclined in the direction of rotation for assembling the electrical connector, (ii) a radially inwardly extending segment located at an end of the inclined segment, the radial segment defines the complementary surface, and (iii) an orthogonal segment which extends substantially orthogonally from the radial segment.

9. The electrical connector according to claim 8, wherein the orthogonal segment defines the exposed portion.

10. The electrical connector according to claim 6, wherein the resilient detent member is made of spring steel.

* * * * *

UNITED STATES PATENT AND TRADEMARK OFFICE

CERTIFICATE OF CORRECTION

PATENT NO. : 5,743,763
DATED : April 28, 1998
INVENTOR(S) : Giovanni Mapelli

It is certified that error appears in the above-indentified patent and that said Letters Patent is hereby corrected as shown below:

On the title page, item [75]

Change inventor's name from "Mapelli Giovanni" to --Giovanni Mapelli.--

Signed and Sealed this

Sixteenth Day of June, 1998

*Attest:*

*Attesting Officer*

Bruce Lehman

BRUCE LEHMAN

*Commissioner of Patents and Trademarks*